US006776407B2

(12) United States Patent
Lindenmayer et al.

(10) Patent No.: US 6,776,407 B2
(45) Date of Patent: Aug. 17, 2004

(54) DEVICE FOR THE STACKING OF FLEXIBLE OBJECTS

(75) Inventors: Bernd Lindenmayer, Bodman Ludwigshafen (DE); Dietmar Oexle, Singen (DE); Rolf Peter Skrdlant, Constance (DE)

(73) Assignee: Siemens AG, Munich (DE)

( * ) Notice: Subject to any disclaimer, the term of this patent is extended or adjusted under 35 U.S.C. 154(b) by 0 days.

(21) Appl. No.: 10/347,211

(22) Filed: Jan. 21, 2003

(65) Prior Publication Data

US 2004/0084836 A1 May 6, 2004

Related U.S. Application Data

(63) Continuation of application No. PCT/DE02/01324, filed on Nov. 4, 2002.

(30) Foreign Application Priority Data

Apr. 17, 2001 (DE) ..... 101 18 758

(51) Int. Cl.[7] ..... B65H 43/00
(52) U.S. Cl. ..... 271/176; 271/207
(58) Field of Search ..... 271/176, 207, 271/220, 223, 224, 303, 181, 177; 414/794.4; 209/900

(56) References Cited

U.S. PATENT DOCUMENTS

RE34,330 E * 8/1993 Daboub ..... 271/305
5,765,827 A * 6/1998 Gillmann ..... 271/300
6,065,748 A * 5/2000 Hutson ..... 271/222
6,161,830 A * 12/2000 Yap ..... 271/181
6,302,638 B1 * 10/2001 Eggebrecht et al. ..... 414/798.7
6,481,712 B1 * 11/2002 Yap ..... 271/303
6,491,492 B1 * 12/2002 Cook ..... 414/789.9
6,634,639 B2 * 10/2003 Kuroda et al. ..... 271/178

* cited by examiner

*Primary Examiner*—David H. Bollinger
(74) *Attorney, Agent, or Firm*—Jacob Eisenberg Siemens AG

(57) ABSTRACT

The present invention relates to a system and method for stacking objects in a stack. The objects may be flat flexible objects with front and back edges being narrower than side walls. Accordingly, the objects may comprise mail pieces. Per the invention, the mail pieces are directed to a stacker. The stacker comprises an impact wall with abutting installation and limiting walls. Accordingly, the stack may be formed therebetween with the installation wall being urged towards the limiting wall so as to sandwich the stack. At least one diverter element or vain is included upstream from the stacker. A roller of a conveying element is positioned upstream from the upper most vain. An object is directed towards the impact wall. When the objects leading edge impacts the wall, the vain or roller closest to the trailing portion of the object causes the trailing portion to be urged towards the stack. The vains may be pivoted while the roller made to turn in a select manner. Accordingly, trailing edges of objects do not interfere with leading edges of subsequent objects.

26 Claims, 4 Drawing Sheets

DEVICE FOR THE STACKING OF FLEXIBLE OBJECTS

CROSS REFERENCE TO RELATED APPLICATIONS

The present application is a continuation of and claims priority to International Application number PCT/DE02/01324, filed Apr. 11, 2002 and further claims priority to German patent application number 10118758.0, filed Apr. 17, 2001, the both of which are herein incorporated by reference.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

The present invention relates to the field of object stacking and more particularly to a system and method for stacking substantially flexible objects. The objects may also be substantially flat and further comprise mail pieces, although application of the present invention is not related to just mail handling. For purposes of illustration only, the present invention will be described with respect to a first non-limiting application to mail pieces. The mail pieces are stacked standing in a stacker with their narrow side facing forward. The successively and individually supplied mail pieces are routed to a movable installation wall against which they lean with their side wall facing the installation wall. In this position, the mail pieces are further stacked in a stack with their front edge facing forward against an impact wall. The stacking process is aided by a stacking roller.

Mail pieces come in a wide variety of formats (lengths, heights, widths, flexibilities, etc.). Normal mail handling entails successive mail piece transport in relatively close succession. Such transport general occurs with the mail pieces sandwiched between elastic straps. It is necessary to get the back edge of a forward mail piece out of the way of the front edge of a trailing mail piece. This is effected by a so-called "clearing of the insertion triangle" during stacking.

To facilitate stacking, a powered stack spindle is set out in DE 3 317 865 A1. The spindle is located closely in front of each stacker and deflects the objects in the direction of movement to the stack. Accordingly, successive objects do not meet with the rear edges but sideways with the already stacked objects. The power introduction occurs at the lower edge of the objects. This results in twistings of particularly high objects because of mass reactance, i.e. the upper rear edge doesn't clear the "insertion triangle" on time or at all.

Additional deflection elements, for example pivoting levers which are similar to diverter vanes, are known from U.S. Re. 34,330. The deflection element is hereby designed as a counter current diverter element, i.e. the tip directs opposite the direction of transport of the objects in motion. If the deflecting element is not engaged before it is reached by the front edge of an object, it collides frontally with the object which can lead to its destruction.

With these known solutions, the power introduction point lies at a respectively determined location. The functionality of certain lengths of objects is thereby limited. With mail pieces which are too long, the distance between the rear edge of the object and the power introduction point is often too large. The objects deform, conditioned on their mass reactance, their rear edge is not brought out from the insertion triangle, and there is the risk of a collision with a successive object. With objects which are too short, the rear edge is met partially or not at all by the function element which introduces power. Accordingly a need exists in the art to facilitate better operation of the insertion triangle while accommodating a widest possible variety of object format.

SUMMARY OF THE INVENTION

The present invention is directed to addressing the above needs. An advantage of the present direction is its use of relatively generic devices thereby enjoying a wide applicability. The present invention concerns a generic device for the stacking of flat, flexible, on a narrow side standing objects, into a stacker which guarantees a mostly trouble free stacking without collision of rear and front edges of successive objects. Application of the present invention is also found with objects of a wide length and format spectrum.

These and other advantages are solved by a system CLAIM 1.

The present system makes use of deflecting elements strategically placed in succession along the conveyance path of the objects. The deflecting elements generally engage the rearward parts of the objects (with respect to conveyance direction). A determination is made of the space or distance between successive objects. The selection and prior known speed of conveyance allows for the determination of location and time of arrival. Accordingly, the deflection elements can be selectively triggered to engage the objects at specific locations. This accommodates objects of different format. In operation, a rearward part of the object is deflected by the deflecting element as a front part enters a stacking roller area. Accordingly, collision between successive objects is avoided.

It is further advantageous, to determine the starting time of the deflection movement of the determined respective deflecting element in such a way that a contact point between the deflecting element and the object doesn't exceed a maximal distance of the rear edge. It is thereby avoided that very flexible, thin objects, don't bend around the contact point and that the rear edge remains approximately in the non-deflecting position.

It is also advantageous, to realize the deflecting elements as diverter vanes, whose tip points in a conveyance direction in a non-deflecting condition or position (co-current diverter). A frontal collision of the objects with the diverter vane is thereby avoided as it would be possible at a diverter of a counter current diverter.

If the diverter vane is applied in such a way that the sides diverge and the tip forms an arc of a circle, so that there is no free space between the diverter vane and guide during deflection, an object rebound from an impact wall can not get into a spacing and get jammed.

In a further advantageous design, elastic and/or an elastically fixated conveyor roller is placed in the conveying path associated with a stacker. The roller presses the objects against the guide and rotates in a conveying direction at a relative transport speed. The distance of the conveyor roller from the impact wall is shorter than the longest objects. In operation, the long objects, if they are braked but are further transported by the conveyor roller, are bent in the middle in an installation wall/stack direction. If the rear edge then leaves the conveyor roller, the rear part of the long object is then thrown in a stack direction by the conveyor roller and due to internal stress from deflection.

In order to avoid unwanted contact of the deflecting elements with the successive objects, time and duration of the deflections of the deflecting elements are determined in such a way that the deflecting elements will have reached a resting position before the next object comes along.

If no object is stacked for a longer period of time, i.e. no objects come into the area of the deflecting elements, it is advantageous, to leave the deflecting elements in the non-deflecting position during this time, to avoid that the rear part of the stacked objects move backwards into the "insertion triangle" because of weights or internal stresses.

BRIEF DESCRIPTION OF THE SEVERAL VIEWS OF THE DRAWINGS

The novel features and method steps believed characteristic of the invention are set out in the claims below. The invention itself, however, as well as other features and advantages thereof, are best understood by reference to the detailed description, which follows, when read in conjunction with the accompanying drawing, wherein:

DETAILED DESCRIPTION OF THE INVENTION

Figure 1:
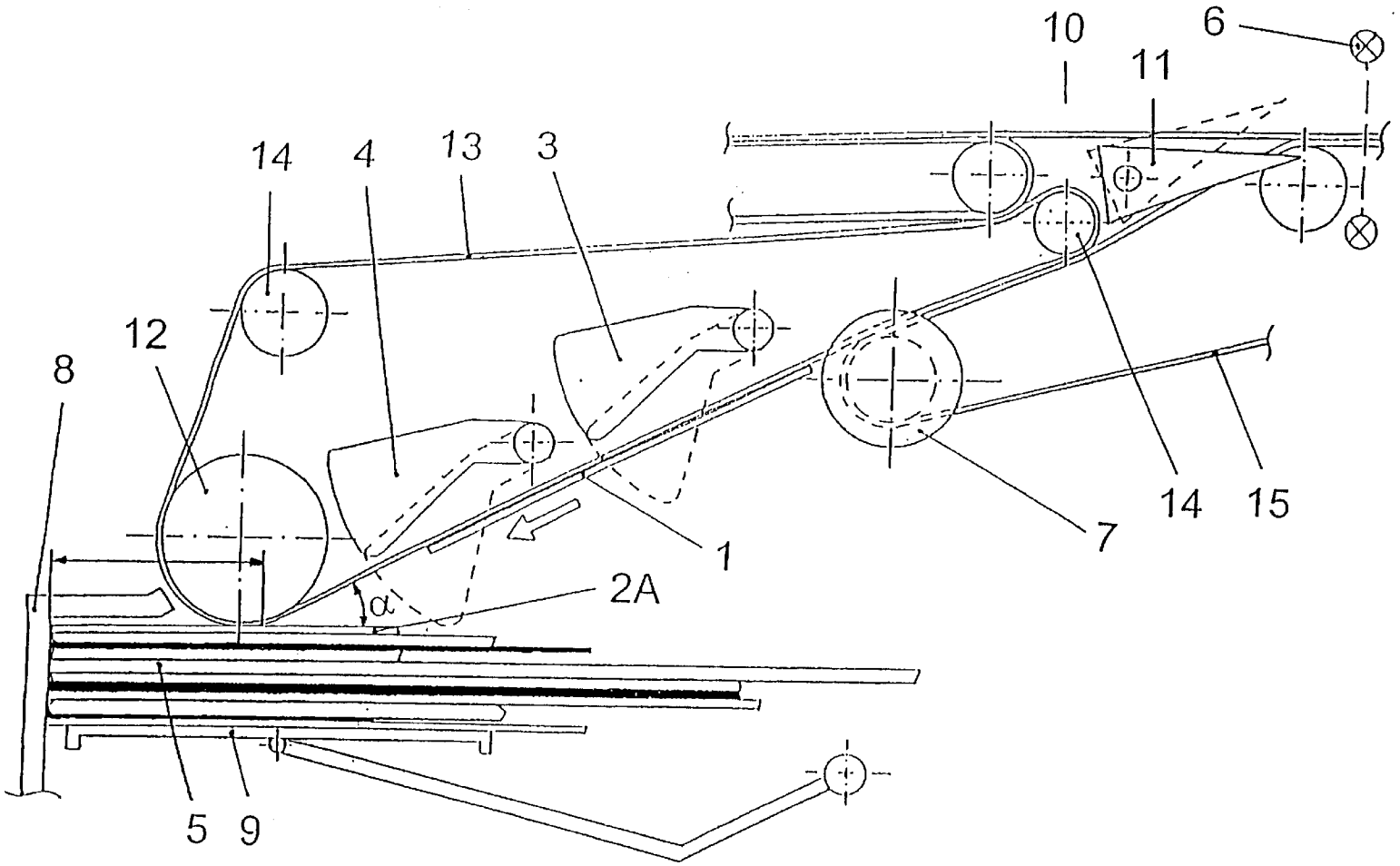
FIG. 1 depicts a top view of a first embodiment of the present invention.

FIG. 1 depicts the routing of mail pieces 1, 2 into a stack. As discussed above, the present invention is not limited to mail piece handling. Returning to the figure, several stackers may be successively arranged along a mail piece conveyance track and/or within a sorting machine or system. The mail pieces 1, 2 are squeezed between straps of a cover band system in a main carrying branch and transported along the numerous stackers to a select final stacker location. Should a certain mail piece be sorted into a certain stacker, based for example on its read receiver address, the mail piece is deflected in the direction of the respective stacker by counter current diverters 10 which are located upstream.

Deflection is facilitated by counter current diverter vanes 11 which divert the mail pieces into the main transport branch. In the depiction, vane 11 would be diverting mail pieces 1, 2 downward, diagonally towards the lower left hand corner of the page. The straps which carry the mail pieces 1, 2 are narrow by design so that the diverter vanes can deflect into the conveying paths above and below the straps.

A light barrier 6 is located in front of counter current diverter 10, with which the front and rear edges of the mail items 1, 2 are detected. Because the transport speed is known, the lengths of the mail pieces, the intervals between the mail pieces, and the switching times of the diverter vanes, can be determined by means of controllers known in the art.

Counter current diverter 10, in association with diverter vain 11, redirect incident mail pieces towards a select stack, herein stack 5. The mail pieces, upon deflection, are picked up by a combination effect of conveyor roller 7 operating band 15, and, rollers 12 and 14 operating another band. The two cooperate to transport mail pieces therebetween. Operating band or transport straps 15 are limited to the location of roller 7. Accordingly, the final leg of the mail pieces 1, 2 to stack 5 is effected by stacking roller 12.

Upon arrival at the stack, the mail pieces encounter an impact wall 8 running perpendicular between an installation wall 9 and a limiting wall 30. Impact wall 8 serves to brake or dampen the flight of the mail pieces. Limiting wall 30 puts a limit on the stack height, while installation wall 9 serves to produce a degree of pressure on the stack for it to maintain its integrity.

The mail pieces 1, 2 are stacked such that their side walls abut one another in the direction of the installation wall 9. As depicted, mail piece 2A is stacked while mail piece 1 is enroute to join the other mail pieces. This installation wall 9 presses against the stack in a relatively perpendicular direction thereby urging the stack towards stacking roller 12. The stacking roller 12 with a high coefficient of friction guarantees that the mail pieces are safely transported against the friction of resistance of the installation wall 9 and in particular the other already stacked mail pieces.

In the stack, the mail pieces are positioned such that their front edge abuts the impact wall and side surfaces abut the limiting wall 30 and installation wall 9. Collisions between front edges of incident mail pieces and trailing edges of mail pieces already in the stack can be avoided where the interval between mail pieces is short, the mail pieces are directed rather quickly into a parallel stacking position, the mail pieces are relatively short, the overhand of stacking roller 12 is relatively short, and mail pieces are inherently stiff. The stacking of shorter mail pieces is depicted in FIG. 1.

For longer mail pieces in shorter intervals, the time for the alignment on the basis of the inherent stiffness, etc. is insufficient to clear the so-called insertion triangle, so that front and rear edges would collide. On the way to the stacker, there are therefore several diverter vanes 3, 4 successively arranged to serve as deflecting elements. The diverter vanes are arranged at deflection points located just behind the guide strap 13 (with respect to the mail pieces). The tips of the diverter vanes 3, 4 are directed towards stacking roller 12 when the diverter vanes are in a home position.

In order to timely clear the conveying path into the stacker from the projecting mail pieces or lengths (of successive mail pieces) 1 for effective stacking, the respective diverter vanes 3, 4 are pivoted into the conveying path so as to engage the mail pieces. The pivoting is temporary. The vanes effectively press the rear part of the mail pieces towards stack 5. Diverter vanes are selected according to mail piece size. The diverter vanes are engaged in the time between the mail piece reaching an area about roller 12 and prior to impacting impact wall 8. If the distance between the point of contact (vane and mail piece) and rear edge is too large, then particularly flexible mail pieces can be bent around the contacting points without substantially deflecting the rear edges. As such, the risk of collision would still exist.

Figure 2:
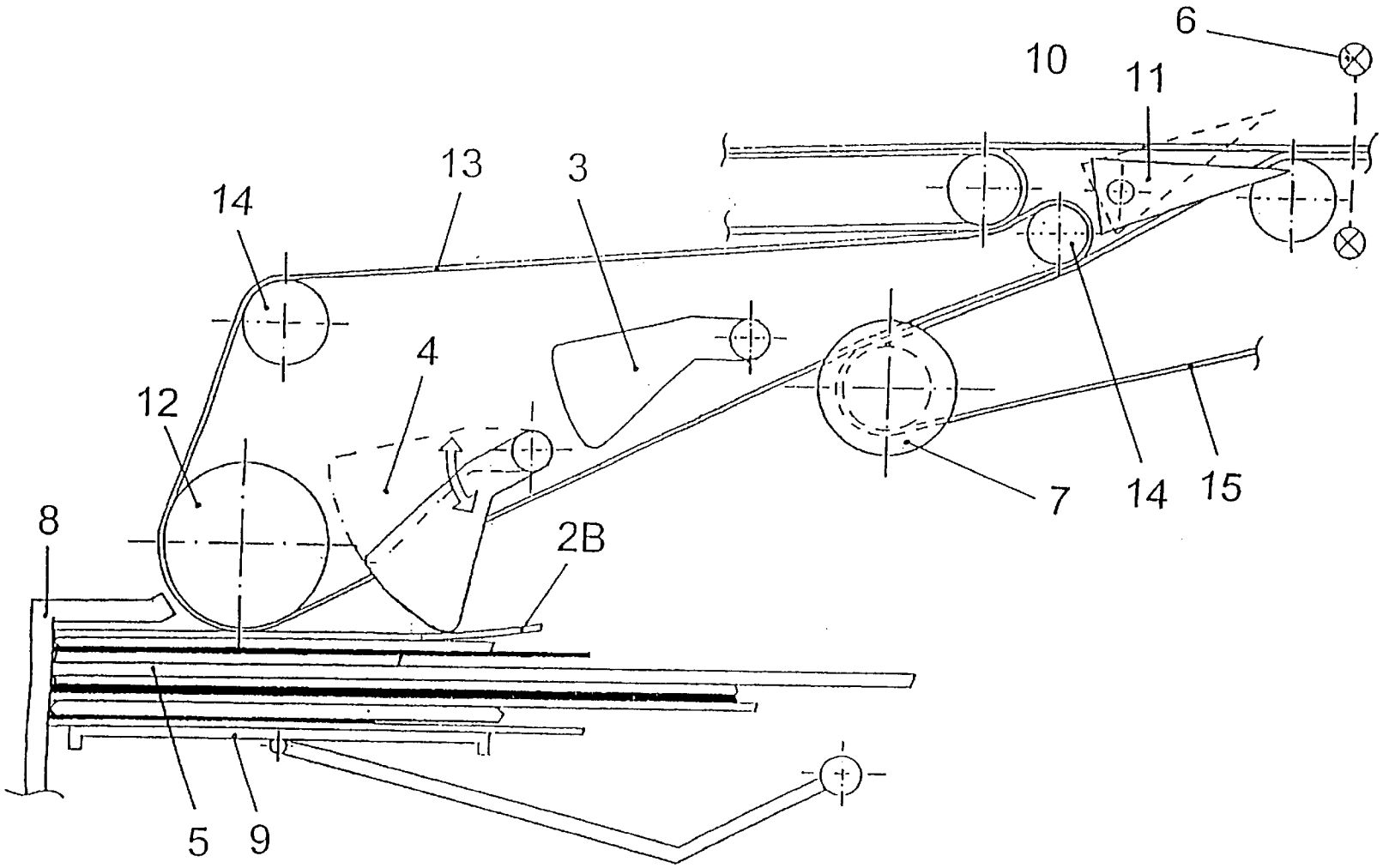
FIG. 2 depicts a top view of a stacking location with a mail piece to be stacked.

FIG. 2 depicts an operation wherein diverting vane 3 is located to far to the rear of the mail piece when the mail piece would enter the area around roller 12 and be set for having its rear portion deflected downward towards the stack 5. For this type of situation, the second diverter vane 4 is engaged. Diverter vane 4 is located closer to the roller 12 than diverter vane 3. As can be envisioned by one skilled in the art, the number and placement of vanes is a design choice based upon particular needs of specific applications of the present invention.

Figure 3:
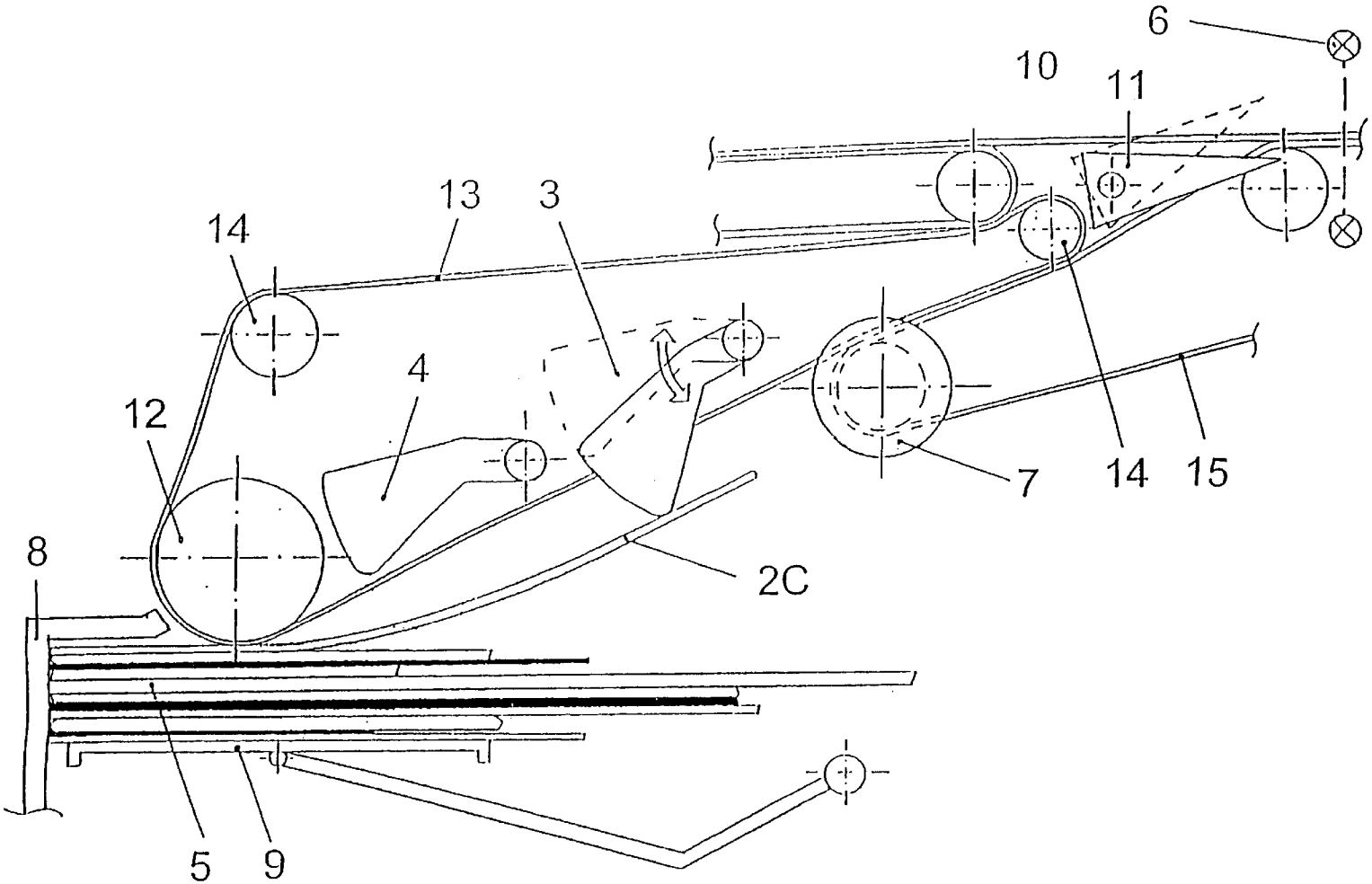
FIG. 3 depicts a top view of a stacking location with another mail piece to be stacked.

FIG. 3 depicts a condition when the mail piece is longer than the distance between diverter vane 4 and stacking roller 12. Herein, the mail piece runs proximate to diverter vane 3, which is implemented, as with diverter vane 4 above, to downwardly urge the back of the mail piece onto stack 5 so as to prevent collision with a subsequent mail piece.

At mail pieces of critical intermediate sizes, i.e. with length, which are below the area of length, where the diverter vane 3 which is closest to the conveyor roller 7 is activated, it is advantageous, to first deflect the diverter vane 3 and the diverter vane 4 as soon as the mail piece has reached the area of the stacking roller 12.

Figure 4:
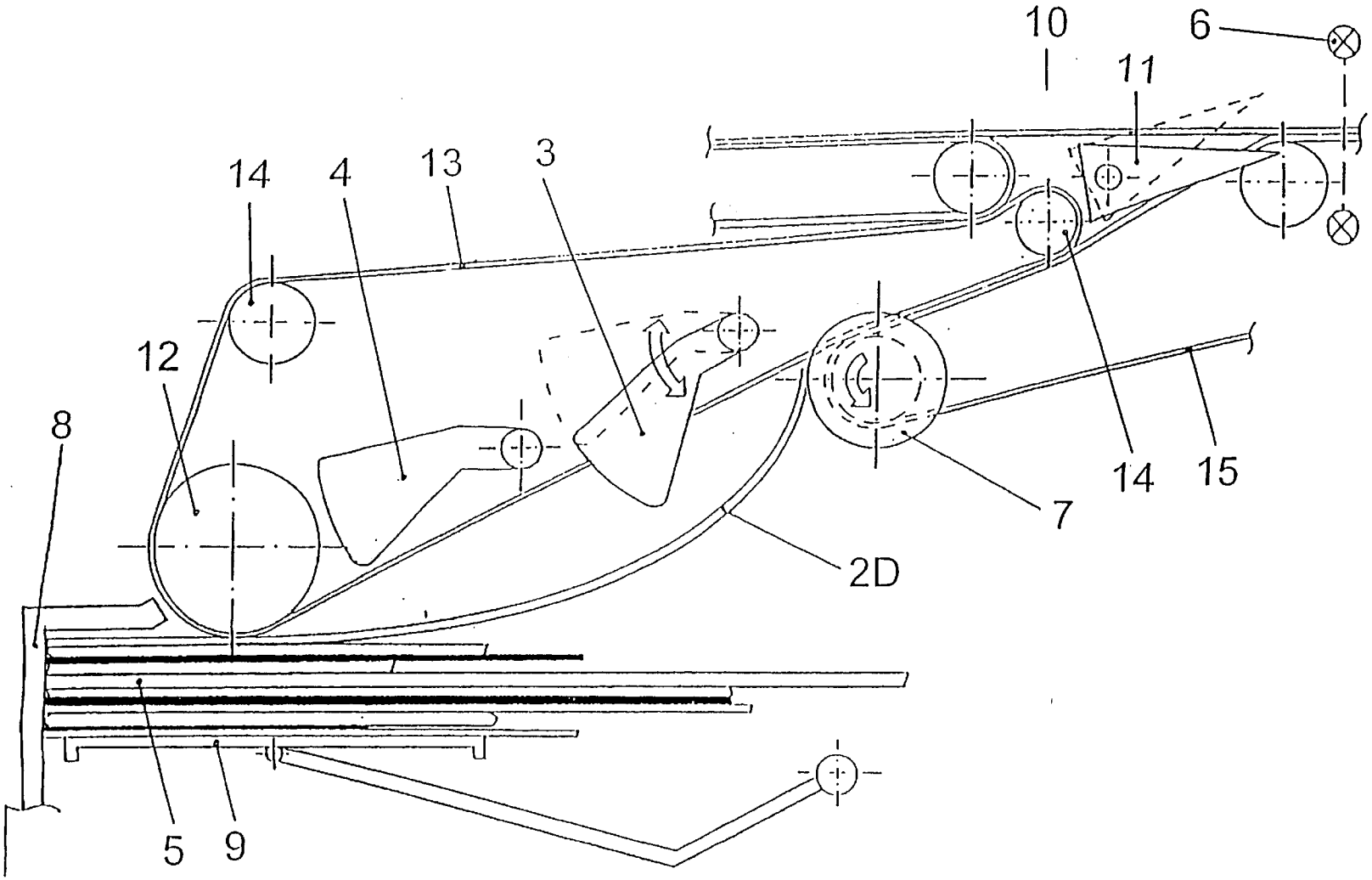
FIG. 4 depicts a top view of a stacking location with a long mail piece to be stacked.

FIG. 4 depicts a situation wherein the mail pieces runs beyond the location of roller 7 as measured from impact wall 8. These longest mail pieces have their rear portions diverted downward by the rotational movement of roller 7. Accordingly, roller 7 may comprise a foam roller and the like. Roller 7 selectively located at a position where a longest mail piece would be released by the cover bands. Herein, the longest mail piece would be positioned in such a way it is marginally caught between the cover bands with its rear part when it reaches the impact wall with its front edge. The mail piece 2D therefore still experiences a continuing urging towards the direction of transport even after reaching the installation wall. Because the mail piece 2D cannot move further towards the impact wall 8, it is deformed, i.e. it arches and comes under tension. The rear edge is thereby pressed against the rotating foam roller. Because of the high coefficient of friction of the foam roller, the rear edge of the mail piece sticks to the roller and is carried around and urged or thrown towards the stack of mail pieces 5 by roller rotation. Accordingly the longest mail piece clears the insertion triangle.

The invention being thus described, it will be obvious that the same may be varied in many ways. The variations are not to be regarded as a departure from the spirit and scope of the invention, and all such modifications as would be obvious to one skilled in the art are intended to be included within the scope of the following claims.

We claim:

1. A system for stacking an object in a stack, said object comprising walls defining an object leading edge, object trailing edge and object lateral side walls, comprising:

a stacker for receiving and facilitating stacking of said object, said stacker comprising an impact wall, for braking a forward motion of said object;

at least one deflecting element positioned upstream from said stacker and along a path of object conveyance to said stack, said at least one deflecting element comprising walls which pivot downward to engage a trailing portion of a passing object so as to urge said trailing portion towards said stack;

control means in communication with said at least one deflecting element and an information source, said information source providing said control means with at least a size of said object and a speed of conveyance of said object, and said control means effecting pivoting of said at least one deflecting element based on at least said size.

2. The system according to claim 1, wherein said at least one deflecting element is engaged after a leading edge of said object has impacted said impact wall.

3. The system according to claim 2, wherein said at least one deflection element comprises a plurality of deflection elements each comprising a tip, pointing in the direction of object conveyance, and side walls, defining an arc.

4. The system according to claim 1, wherein said impact wall comprises a first end and a second end, said stacker further comprises an installation wall and a limiting wall, said first end abuts said installation wall and said second end abuts said limiting wall such that said stack is formed with said leading edge abutting said impact wall and said lateral side walls facing said limiting wall and installation wall.

5. The system according to claim 4, further comprising installation wall urging means in functional cooperation with said installation wall for urging said installation wall in the direction of said limiting wall thereby sandwiching said stack therebetween.

6. The system according to claim 1, wherein said information source further provides said control means with an indication of said object location.

7. The system according to claim 6, wherein said object location includes location of said leading and trailing edge.

8. The system according to claim 7, wherein said information source further provides said control means with an indication of spacing between said object and another object.

9. The system according to claim 1, further comprising at least one conveying means for effecting said object conveyance, said conveying means comprising a plurality of rollers operating an endless band, said band urging said object along said path.

10. The system according to claim 9, wherein operation of said at least one conveying means is controlled by said control means.

11. The system according to claim 10, wherein said at least one conveying means comprises cooperating first and a second conveying means, said first conveying means located upstream from said second conveying means, said first conveying means defining a stacking roller proximate to said stack and a two other rollers distally located from said stack, said second conveying means comprising a conveyor roller located at a downstream most location of said second conveying means and upstream from said stacking roller, and said elements are positioned between said stacking roller and said conveyor roller.

12. The system according to claim 11, wherein said control means pivots an element which is located closest to said trailing edge when said object is less than a distance along said path between said stacking roller and conveyor roller.

13. The system according to claim 12, wherein said control means does not activate an element when said object is greater than said distance.

14. The system according to claim 13, further comprising a diverter vain for selectively diverting an object conveyed by another conveying means to said first and second conveying means.

15. The system according to claim 1, wherein said leading and trailing edges are narrower than said lateral side walls.

16. The system according to claim 15, wherein said object is a mail piece.

17. A method for stacking an object in a stack, said object comprising walls defining an object leading edge, object trailing edge and object lateral side walls, comprising the steps of:

conveying said object along a path to a stacker comprising an impact wall;

determining object length and object location;

determining when said object has impacted said impact wall, and pivoting a diverter element positioned along said path such that said element urges a trailing portion of said object in a direction of said stack, said pivoting depending upon a select object length and object location.

18. The method according to claim 17, wherein said diverter element comprises a plurality of elements comprising tips, pointing in the direction of object conveyance, and side walls, defining an arc.

19. The method according to claim 17, wherein said impact wall comprises a first end and a second end, said stacker further comprises an installation wall and a limiting wall, said first end abuts said installation wall and said second end abuts said limiting wall such that said stack is formed with a leading edge of said object abutting said impact wall and lateral sides of said object facing said limiting wall and installation wall and further comprising the step of urging said installation wall in the direction of said limiting wall thereby sandwiching said stack therebetween.

20. The method according to claim 17, wherein said object location includes location of a leading and trailing edge of said object.

21. The method according to claim 17, wherein said step of conveying further comprises the steps of implementing at least one conveying means for effecting object conveyance, said conveying means comprising a plurality of rollers operating an endless band, said band urging said object along said path.

22. The method according to claim 21, wherein said step of determining object length further comprises the step of determining spacing distance between said object and another object and said step of pivoting further depending upon a select spacing distance.

23. The method according to claim 21, wherein said at least one conveying means comprises cooperating first and a second conveying means, said first conveying means located upstream from said second conveying means, said first conveying means defining a stacking roller proximate to said stack and a two other rollers distally located from said stack, said second conveying means comprising a conveyor roller located at a downstream most location of said second conveying means and upstream from said stacking roller, and said element comprises a plurality of elements positioned between said stacking roller and said conveyor roller.

24. The method according to claim 23, wherein said step of pivoting further comprises the steps of determining which element is located closest to said trailing edge and when said object is less than a distance along said path between said stacking roller and conveyor roller, pivoting said closest element.

25. The method according to claim 24, said step of pivoting further comprises the step of determining if said object length is greater than said distance, and if so, not performing said step of pivoting.

26. The method according to claim 25, further comprising the step of diverting a diverter vain, for selectively diverting an object conveyed by another conveying means to said first and second conveying means, said diverter vain positioned upstream from said first and second conveying means.

* * * * *